US005911419A

United States Patent [19]

Delaney et al.

[11] Patent Number: 5,911,419

[45] Date of Patent: Jun. 15, 1999

[54] METHOD AND APPARATUS FOR PLAYING BETTOR'S CHOICE DRAW POKER

[76] Inventors: Thomas A. Delaney, 549 Bonita Ave., Las Vegas, Nev. 89104; Bennett M. Wilgard, 4713 Sun Glory Ct., Las Vegas, Nev. 89130

[21] Appl. No.: 08/944,459

[22] Filed: Oct. 6, 1997

Related U.S. Application Data

[60] Provisional application No. 60/035,586, Jan. 17, 1997.

[51] Int. Cl.[6] ..... A63F 1/10

[52] U.S. Cl. ..... 273/292; 273/309; 273/148 A

[58] Field of Search ..... 273/292, 309, 273/274, 148 A; 463/13

[56] References Cited

U.S. PATENT DOCUMENTS

| | | | |
|---|---|---|---|
| 4,362,303 | 12/1982 | Pell | 273/274 |
| 4,836,553 | 6/1989 | Suttle et al. | 273/292 |
| 4,861,041 | 8/1989 | Jones | 273/292 |
| 5,265,882 | 11/1993 | Malek | 273/292 |
| 5,364,104 | 11/1994 | Jones et al. | 273/292 |
| 5,407,208 | 4/1995 | Keller et al. | 273/274 |
| 5,411,257 | 5/1995 | Fulton | 463/13 |
| 5,415,404 | 5/1995 | Joshi et al. | 463/13 |
| 5,486,005 | 1/1996 | Neal | 273/292 |
| 5,494,295 | 2/1996 | Potter | 273/292 |

OTHER PUBLICATIONS

Casino Journal, Hot Slots : Bally Gaming Multiple Actionby Frank Legato, vol. 8, No. 10 Oct. 1995, pp. 1, 39–41.

*Primary Examiner*—Benjamin H. Layno
*Attorney, Agent, or Firm*—Harry M. Weiss; Jeffrey D. Moy; Harry M. Weiss & Associates, P.C.

[57] ABSTRACT

A method and apparatus for playing card wagering games that enables players to select the playing card game to be played for a particular wagering round from among multiple playing card game options. Where different decks of playing cards are required for certain of the optional playing card games, a multi-deck card holder is provided, permitting a dealer to make an immediate selection of the appropriate playing cards upon selection of the playing card game by a player at that table. Upon the conclusion of one wagering round, selection of the next playing card game is made by the same or a different player, and the play continues with the selection of playing card games entirely at the option of the players.

23 Claims, 3 Drawing Sheets

METHOD AND APPARATUS FOR PLAYING BETTOR'S CHOICE DRAW POKER

CROSS-REFERENCE TO RELATED APPLICATION

This application claims the benefit of U.S. Provisional application Ser. No. 60/035,586, filed Jan. 17, 1997.

BACKGROUND OF THE INVENTION

1. Field of the Invention

The present invention relates to playing card games of skill and chance and, more particularly, to such playing card games as are suitable for use in casinos, and to a specifically-designed table for playing such games. More specifically, this invention relates to a method and apparatus for permitting a player to select, for the entire table, the next playing card game to be played from among several available playing card games, such as different types of poker.

2. Description of the Prior Art

Card games can be educational, stimulating, as well as an exciting social activity. The same characteristics are further enhanced when the card game is combined with the opportunity for wagering.

As a leisure time activity, five card poker is a game that almost everyone knows how to play. Many variations on poker have been developed, using the same basic priority or rank order of playing cards to define winning hands: Royal Flush; Straight Flush; Four of a Kind; Full House; Flush; Straight; Three of a Kind; Two Pair; One Pair; and High Cards in a Hand.

In those areas having legalized gaming, conventional card room poker is frequently offered as one of the games of chance. The house provides a dealer, the playing cards, the table and chairs, but does not actively participate in the game itself. The house will collect a nominal percentage of each player's bet (known as the "rake"), to compensate the house for providing the facilities, dealer, etc. to the players.

The game of poker tends to emphasize a competitive aspect that appeals to card players that are more confident of their skill level and are less reliant on "luck". Additionally, since the transfer of money during a poker game occurs as among the players of that game, many people are uncomfortable with such a direct connection between one group member's gain and another's loss. "Bank" style games are more appropriate for such players, where play is against an impersonal "house", and winning wagers are paid out of a "corporate" common fund. Additionally, in bank-style games, most players are aware that the "house" shapes the winning odds to assure a statistical advantage.

Conventional card room poker also does not offer a player any bonus payment for particularly good hands. Although a Royal Flush is a rare occurrence, and of course is thrilling for any player fortunate enough to obtain such a hand, that player will collect the same total wager that otherwise would have been collected if all that were needed to win a particular hand was a Three-of-a-Kind.

With these characteristics casinos have been reluctant to devote much table space to the game of poker. In comparison with other casino games, poker's relative lack of popularity and its low dollar return to the house has resulted in minimal space given for poker tables.

In response, there have been attempts to bring excitement to poker tables, such as by modifying poker to include bonus payments and enable play against a banker (house) in "Caribbean Stud Poker™" (Suttle, et al., U.S. Pat. No. 4,836,553). In Malek, U.S. Pat. No. 5,265,882, the players can play an amalgam of Twenty-One, modified Draw Poker, and Baccarat simultaneously as one game against both the dealer and the other players. In Neal, U.S. Pat. No. 5,486,005, seven individual "table" hands are dealt, with the players and dealer then placing wagers based upon the perceived value of individual hands or combinations of these seven hands.

Ideally, it would be desirable to devise a manner of playing poker or other playing card games that produces player excitement without requiring modifications to the rules of play for well-known and historically-enjoyed playing card games.

SUMMARY OF THE INVENTION

It is an object of the present invention to bring player excitement to poker games by permitting a player to decide which one of several poker (or other) card games will be played at that table on the next deal. In addition to permitting the players to select the type of poker game (or other card game) that is to be played for a particular hand, further wagering excitement is provided by including both "bonus" and "progressive" style betting.

The present invention also contemplates the use of a "Share the Wealth™" Jackpot, wherein each player having placed a "jackpot bet" will obtain a pro rata share of the jackpot, based upon the number of players present or player-positions at the table. The jackpot amount can be either a fixed amount, seeded by the casino, a progressive amount localized to that table only, or a combination of the two.

Where different decks of playing cards are required for the particular game options, a divided card holder is provided the dealer, permitting the immediate selection of the appropriate deck of playing cards. This fast and easy access to the correct playing cards permits the dealer to promptly deal a particular game, immediately upon its selection by the player.

Some further objects and advantages of the present invention shall become apparent from the ensuing description and as illustrated in the accompanying drawings.

DETAILED DESCRIPTION OF THE PREFERRED EMBODIMENTS

As used in this specification the term "casino card game" refers to a card game in which the casino or "house" acts as the banker, collecting all losing wagers and paying all winning wagers. The casino is the "dealer" of the game. There is no head-to-head competition between players, and instead each player attempts to obtain the "best" hand possible, in accordance with a pre-defined pay out table.

Additionally, although the play of the game will be illustrated by making reference to a specific game layout, it should be understood and appreciated that the player-option casino game system of the present invention can be played with a different layout, or without the use of a layout (video poker machines, CD-ROM home versions of the game, internet gaming, etc.), and still be within the scope of the present invention.

Figure 1:
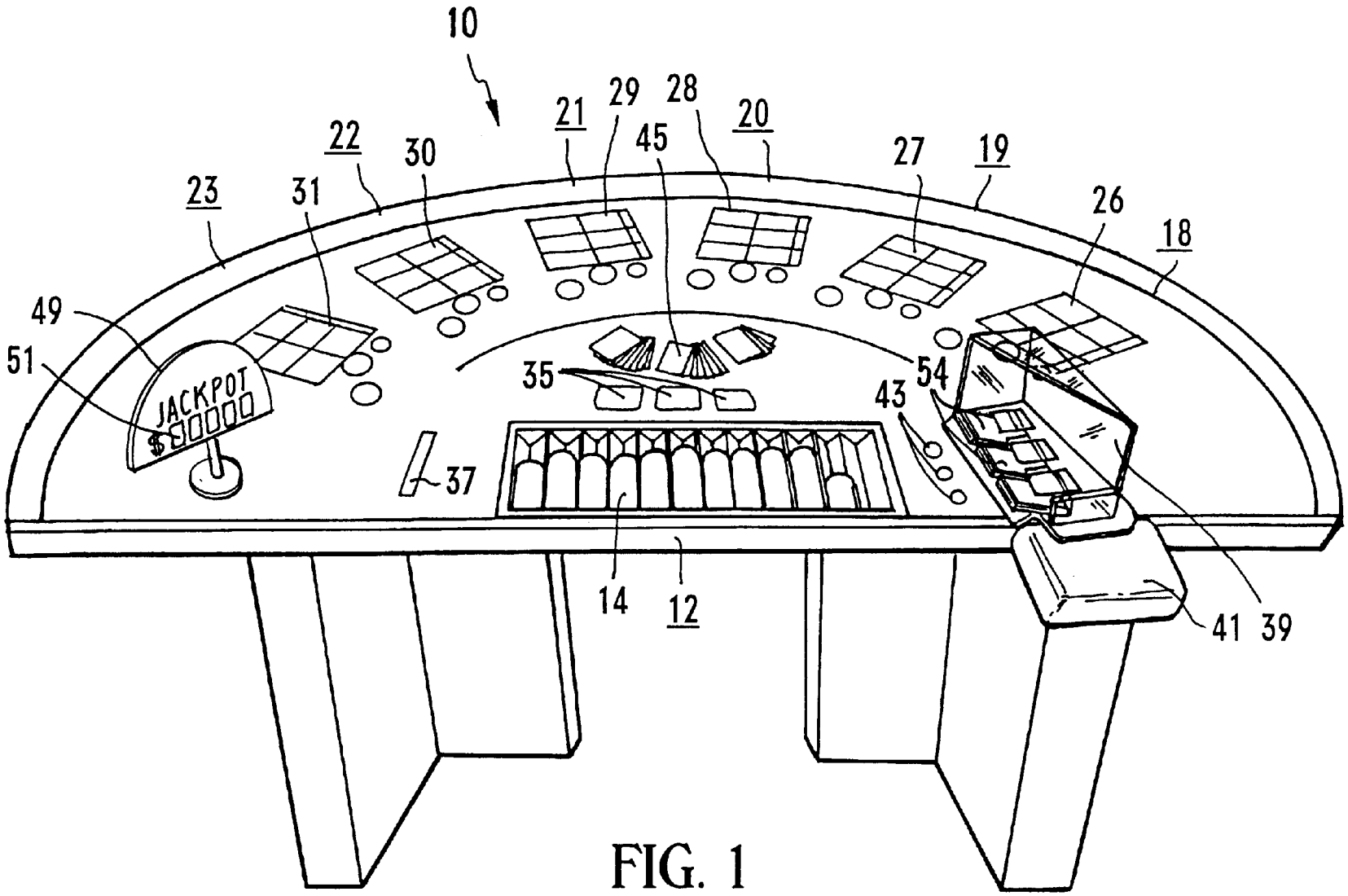
FIG. 1 is a perspective view showing a gaming table constructed in accordance with the principles of the present invention.

Reference is now made to the drawings wherein like numerals refer to like parts throughout. Referring to FIG. 1, there is shown a gaming table constructed in accordance with the principles of the present invention and designated generally by reference numeral 10. In one preferred embodiment, the gaming table 10 is generally semicircular in shape, and is preferably sized to have approximately the same dimensions as a conventional casino gaming table of the type normally used to play blackjack.

A dealer position 12 is located at the center along the linear, rear edge of the gaming table 10. An area is provided immediately adjacent the dealer position 12 for placement of a chip tray 14. Casino games are typically played using chips rather than actual currency, and the chip tray 14 is used by a dealer as a bank, holding chips to pay winning wagers and receiving chips from losing bets. A plurality of playing positions 18, 19, 20, 21, 22, 23 are spaced around the arcuate portion of the gaming table 10.

Immediately adjacent each of the playing positions 18–23 are located a respective player playing area 26, 27, 28, 29, 30, 31. Each of the player playing areas 26–31 defines an area for placement of wagers by each player, enumerates the payoff odds for each specific winning hand, and defines the "bonus" hands as well as identifying the "bonus" payoffs. Corresponding to this schedule of regular and bonus payoffs are a sequence of dealer's pay tables 35 located in front of the dealer position 12 adjacent the chip tray 14. The dealer's pay tables 35 serve as a convenient reference for the dealer during play of the game.

In addition to being provided the chip tray 14, a money paddle 37 is provided the dealer for use as a cash drop. A multi-deck card holder 39 is located adjacent the chip tray 14. In a preferred embodiment three separate playing card casino games are available options to the players, and in such instance, the multi-deck card holder 39 is known as a "Triple Decker™". A table extension 41 is provided adjacent the dealer position 12. Placing the multi-deck card holder 39 at least partially on the table extension 41 further distances it from the playing positions 18–23, enhancing security.

A plurality of indicator tokens 43 are located immediately adjacent the multi-deck card holder 39. The indicator tokens 43 are utilized during play of the game to identify the card game in play during a particular hand, as well as to identify the player who made the game selection. Identification of the types of playing card games available for selection by the players is preferably provided, and is located mid-table in an identification field 45.

Finally, the gaming system of the present invention optionally provides a jackpot specific for each gaming table. Preferably, this jackpot is a permanent jackpot, seeded by the casino. Alternatively, it can be the result of a mandatory additional ante from all of the players, or it can accumulate as a result of a combination of these two types of funding.

As originally contemplated, a physical "jackpot bank" (not shown) would be placed on each table, perhaps of transparent materials to visually display the amount of accumulating paper currency. Security considerations suggest the appropriateness of utilizing a jackpot merchandiser 49 that is placed on a particular gaming table 10, identifying that particular table as participating in a jackpot wagering event. Additionally, as is depicted in FIG. 1, the jackpot merchandiser 49 preferably also includes amount indicia 51 that identifies the dollar amount of the jackpot award for that particular gaming table.

Figure 2:
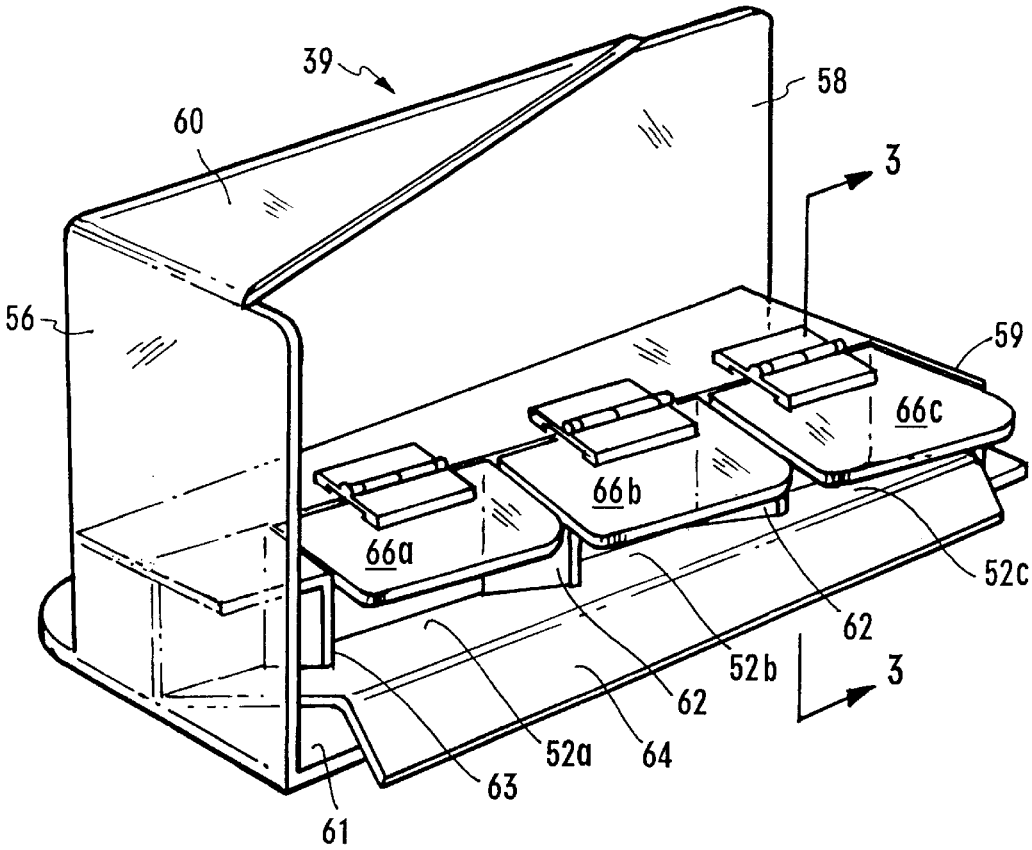
FIG. 2 is a perspective view showing a multiple deck playing card holder in accordance with the present invention.

Turning now to FIG. 2, a presently preferred embodiment for the multi-deck card holder 39 is provided. Where different decks of playing cards are required for the particular game options available to each of the players, the multi-deck card holder 39 is designed to retain and keep separate each of the required playing card decks, thereby permitting the dealer to be in a position to promptly deal a particular game once it has been selected by a player. The multi-deck card holder 39 is divided into a plurality of individual card deck compartments 52 (three compartments 52*a*, 52*b*, 52*c* are shown in FIG. 2). Each of the individual card deck compartments 52 are preferably sized to receive a single deck of playing cards (not shown in the Figures).

In the preferred embodiment depicted in FIG. 2, the multi-deck card holder 39 is generally constructed as a transparent, open-sided, rectangular box. With the card holder 39 placed on the gaming table 10 during play of the hands, an enlarged side panel 56 and an enlarged back panel 58 assist in restricting access to the cards by players at the table. An end panel 59, a partial cover 60, and a bottom panel 61 complete the outer structure defining the box-like outside of the card holder 39. In a preferred embodiment, the bottom panel 61 is slightly enlarged, extending beyond the enlarged back panel 58 and the end panel 59 to provide a larger footprint for the card holder 39, enhancing its stability.

The individual card deck compartments 52 are defined upon the placement of a preselected number of divider panels 62. Where there will be three separate playing card game options for the players, the placement of two divider panels 62 will create the required three individual card deck compartments 52*a*, 52*b*, 52*c*. Aesthetics suggest the spacing of the initial card deck compartment 52*a* from the enlarged side panel 56, and a positioning panel 63 is provided. Additionally, an angled support deck 64 is provided as the support surface for the playing cards (not shown). By slightly elevating the playing card decks from the gaming table 10, the angled support deck 64 simplifies the task of removing the decks of playing cards from the card deck compartments 52. The decks of playing cards are retained in place on this angled support deck 64 by a support panel 65 (see FIG. 3).

For security purposes it is desirable that a covering be placed over the individual card deck compartments 52 of the multi-deck card holder 39. However, to assure that the dealer will have prompt access to the selected deck of playing cards, it is preferred that a plurality of individual cover panels 66*a*, 66*b*, 66*c* be provided. To further assist the dealer in ease of access to the individual card deck compartments 52, the individual cover panels 66 are attached to the back panel 58 by a hinge 68. This manner of attachment permits the cover panels 66 to be raised, simplifying access to the deck of playing cards (not shown).

Figure 3:
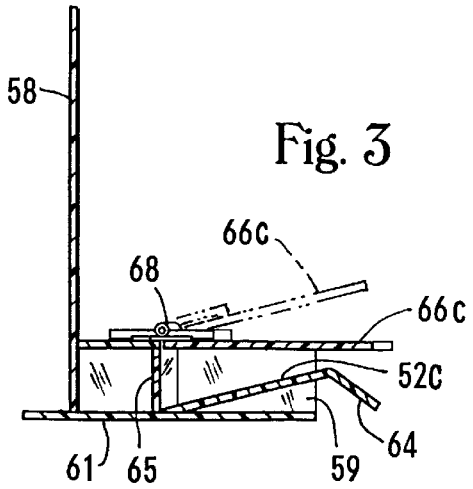
FIG. 3 is a cross-sectional view taken along line 3—3 of FIG. 2 showing a hinged cover panel in use on a multiple deck playing card holder in accordance with the present invention.

FIG. 3 depicts such a raised cover panel position, wherein the individual cover panel 66*c* is shown both lowered, restricting access to the card deck compartment, as well as in a raised position (shown in phantom). As so raised, easy access is provided to the interior portions of the individual card deck compartment 52*c*.

Figure 4:
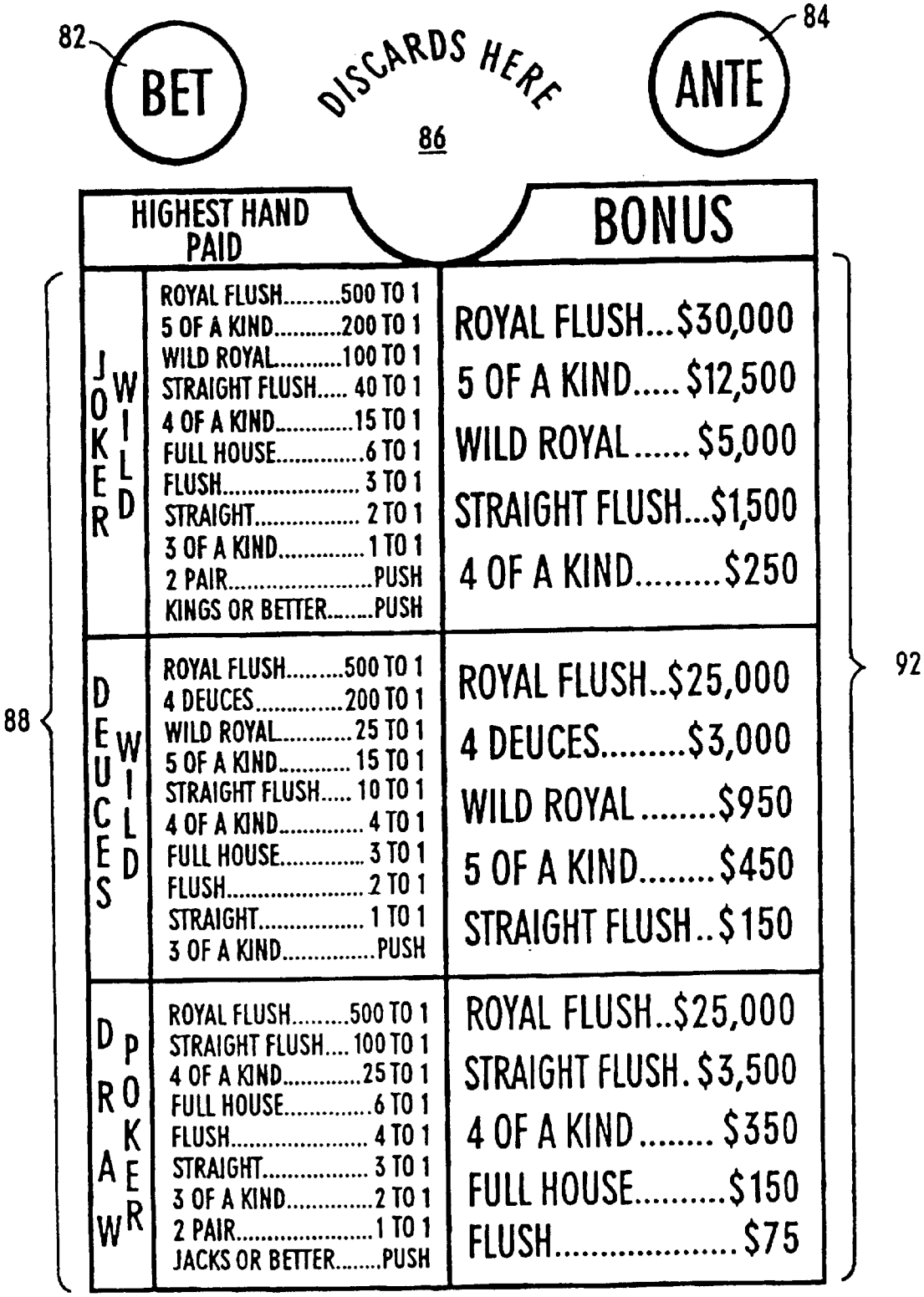
FIG. 4 is a diagrammatic plan view of a typical playing area layout for the card game system described by the present invention.

Additional details regarding the player playing areas are provided with reference to FIG. 4. The majority of poker card games require an initial bet as well as a table ante. Each of the player playing areas 26–31 includes a bet field 82 and an ante field 84. A discard field 86 is also preferably provided, and can be conveniently located between the bet and ante fields 82, 84.

Once the game has been completed, payoffs for the players still remaining in the game are made in accordance with the odds specified in a payoff field 88. Since different types of poker games are options for the players, the payoff field 88 sets forth the odds and payoff for each of the game options. Finally, to add further excitement to the gaming system of the present invention, a bonus field 92 is preferably provided, wherein specified hands in each of the various poker or (other) card game options are accorded bonus dollar amounts.

Although it is to be understood and appreciated that non-poker card games could be available optional games for play at a gaming table, for purposes of illustration, and not of limitation, in the examples discussed below, the players will be making their selection from among those poker games identified in FIG. 3, namely "Joker Wild", "Deuces Wild", and "Draw Poker".

The play of the casino card game system of the present invention preferably utilizes a shuffled, 52-, 53- (or more) -card deck for each of the poker (or other) game options that are to be available for the players. Beginning with the player seated to the dealer's left, the game begins by that player choosing which of the three games are to be played during that next hand.

The dealer announces the game selection to all of the players at the table, and places the appropriate indicator token 43 in front of the player who made the game selection (termed the "buttoned player"). All players will then place their required, table bets, and will be given the opportunity to place an additional, "ante" bet while the dealer shuffles the cards. The dealer collects the table bets and, beginning with "buttoned player" and moving to the dealer's right, the dealer deals one card at a time to each player until all players have the required number of initial cards, in this case, five.

Under the rules of the poker games just identified, players are permitted to draw up to three additional cards after the deal, placing their discards in their respective discard fields 86. A player may also surrender all five of the dealt cards, and forfeit one-half of the player's bet. In any event, beginning once again with the "buttoned player", the dealer removes the discards and replaces them with an equal number of new cards. The dealer will continue on a player-by-player basis, providing replacement cards for any cards discarded, until all of the players have received up to their three new cards, have decided to forfeit or have not accepted any new cards and have decided to "stand pat".

If a player chooses to "stand pat", accepting no new cards, once all of the other players have completed drawing their cards, the player standing pat may declare a bonus hand if that player's original five cards appear on the bonus field 92. The payout prescribed thereunder will be paid to that player, provided that an ante bet had previously been placed, prior to the dealing of the cards. That bonus player also remains eligible for the normal payout set forth on the payoff field 88.

Following payment of the bonus awards, each player's hand is then compared to the payout schedule located in the payoff field 86 in each of the player playing areas 26–31. The game concludes with the dealer paying and taking all bets, from right to left, according to the pay table appropriate for the particular game being played. All cards are discarded back into the proper card deck compartment 52, and the indicator token 43 returned to its proper location. The cover panel 66 is lowered, and a new game selection is made by the next player, with play thereafter continuing in the manner just described, in accordance with the rules of the particular game chosen by the next succeeding player from among the three game options.

The present playing card game invention also contemplates the possible use of a jackpot payout, with utilization of this feature to be at the casino's option. Should such a jackpot feature be chosen, funding is preferably by the casino. Other funding is possible, such as through an additional, player ante, or by blending player sources with the casino. The present invention is not to be viewed as limited with respect to the manner in which the jackpot bet is funded.

Regardless of the source, the jackpot merchandiser 49 identifies those tables having a jackpot. These jackpot funds are restricted towards funding jackpot events occurring on only that specific gaming table. Additionally, the present invention contemplates the distribution of these jackpot funds on a "community" basis. Upon the occurrence of a specific, pre-defined, jackpot playing card event by one of the players at that table—the jackpot funds are to be equally distributed to all of the players at that table.

An example of such a "jackpot event" might include the dealing of a "natural" Royal Flush (as originally dealt, with no draw cards). Again, upon the occurrence of such an event, the jackpot funds are then equally distributed to all of those players at that table that had previously placed an ante bet.

The present invention is further demonstrated by the following examples of play:

EXAMPLE 1

There are six players at the table. Each round, one player will have the opportunity to decide which game will be played that round. In this example, player #1 chooses to play Deuces Wild. The dealer places the Deuces Wild button in front of player #1, selects a deck of playing cards appropriate for Deuces Wild, and announces to all: "You are playing Deuces Wild". All players place a bet and ante. The dealer collects the antes. Starting from the "buttoned" player and moving to the dealer's right, each player receives one card at a time until all players have five cards. All players look at their cards and then must decide whether to fold, (not play original five cards) draw or stand pat (no draw).

The dealer starts with the "buttoned" player, which in this case, is player #1. Player #1 decides to stand pat. The dealer asks the player, "Are you declaring a bonus hand?" The player says, "yes". The dealer then places this player's cards and bet in the appropriate area. Player #2 decides to stand pat. The dealer then asks the player, "Are you declaring a bonus hand?". The player responds by saying that they are not. Player #3 decides to discard three cards and the dealer then replaces them with an equal number of new cards. Player #4 decides to discard two cards and the dealer then replaces them with an equal number of new cards. Player #5 decides to discard one card, so the dealer then takes the discard and replaces it with a new card. Player #6 decides to fold (does not play the original 5 cards) and receives half of the bet back. The dealer now pays and takes in order (dealer's right to left).

Player #6 has already folded, therefore no action will be taken by the dealer. Player #5 does not have a hand that appears on the pay table (loses). The dealer takes the bet. Player #4 has Three of a Kind. The hand is declared a "push". Player #3 has a Flush. The dealer pays the bet the proper odds from the pay table. Player #2 has a Straight Flush. The dealer pays the bet the proper odds from the pay table. Player #1 has Five of a Kind. The dealer pays the bet the proper odds from the pay table and the bonus payout, because this is an original five card bonus hand and Player #1 had placed an additional ante bet.

EXAMPLE 2

There are six players at the table. Each round, one player will have the opportunity to decide which game will be played that round. In this example, the player #1 chooses to play Joker Wild. The dealer places the Joker Wild button in front of player #1, selects a deck of playing cards appropriate for Joker Wild, and announces to all: "You are playing Joker Wild." All players place a bet and ante. The dealer collects the antes. Starting from the "buttoned" player and moving to the dealer's right, each player receives one card at a time until all players have five cards. All players look at their cards and then must decide whether to fold, (not play original five cards) draw or stand pat (no draw).

The dealer starts with the "buttoned" player, which in this case, is player #1. Player #1 decides to stand pat. The dealer asks the player, "Are you declaring a bonus hand?" The player says, "yes". The dealer then places this player's cards and bet in the appropriate area. Player #2 decides to stand pat. The dealer then asks the player, "Are you declaring a bonus hand?". The player responds by saying that they are not. Player #3 decides to discard three cards and the dealer then replaces them with an equal number of new cards. Player #4 decides to discard two cards and the dealer then replaces them with an equal number of new cards. Player #5 decides to discard one card, so the dealer then takes the discard and replaces it with a new card. Player #6 decides to fold (does not play original 5 cards) and receives half of the bet back. The dealer now pays and takes in order (right to left).

Player #6 has already folded, therefore no action will be taken by the dealer. Player #5 does not have a hand that appears on the pay table (loses). The dealer takes the bet. Player #4 has a pair of kings. The hand is declared a "push". Player #3 has three of a kind. The dealer pays the bet the proper odds from the pay table. Player #2 has a Straight. The dealer pays the bet the proper odds from the pay table. Player #1 has Five of a Kind. The dealer pays the bet, based upon the proper odds from the pay table, and the bonus payout, because this is an original five card bonus hand.

EXAMPLE 3

There are six players at the table. Each round, one player will have the opportunity to decide which game will be played that round. In this example, player #1 chooses to play Draw Poker. The dealer places the Draw Poker button in front of player #1, selects a deck of playing cards appropriate for Draw Poker, and announces to all: "You are playing Draw Poker". All players place a bet and ante. The dealer collects the antes. Starting from the "buttoned" player and moving to the dealer's right, each player receives one card at a time until all players have five cards. All players look at their cards and then must decide whether to fold, (not play original five cards) draw or stand pat (no draw).

The dealer starts with the "buttoned" player, which in this case, is player #1. Player #1 decides to stand pat. The dealer asks the player, "Are you declaring a bonus hand?" The player says, "yes". The dealer then places this player's cards and bet in the appropriate area. Player #2 decides to stand pat. The dealer then asks the player, "Are you declaring a bonus hand?". The player responds by saying that they are not. Player #3 decides to discard three cards and the dealer then replaces them with an equal number of new cards. Player #4 decides to discard two cards and the dealer then replaces them with an equal number of new cards. Player #5 decides to discard one card, so the dealer then takes the discard and replaces it with a new card. Player #6 decides to fold (does not play original 5 cards) and receives half of the bet back. The dealer now pays and takes in order (right to left).

Player #6 has already folded, therefore no action will be taken by the dealer. Player #5 does not have a hand that appears on the pay table (loses). The dealer takes the bet. Player #4 has a pair of jacks. The hand is declared a "push". Player #3 has two pair. The dealer pays the bet the proper odds from the pay table. Player #2 has a Flush. The dealer pays the bet the proper odds from the pay table. Player #1 has Four of a Kind. The dealer pays the bet the proper odds from the pay table and the bonus payout, because this is an original five card bonus hand.

If any of these players had been dealt a Royal Flush (in the original five cards), in addition to receiving the proper odds from the pay table and being awarded an additional bonus payout, all money in the jackpot bank at that table will be equally distributed to all players that received a hand (after having placed an initial bet) and placed an ante bet in that game round.

Based upon calculations using well-known techniques, it has been determined through statistical analysis that the house will have an edge of approximately 2.71% with Draw Poker, 2.13% with Joker Poker, and 3.49% with Deuces Wild, for an overall average of 2.78%. These percentages equate to approximately a 20% to 30% hold. Of course, this calculated house advantage will increase when players do not use the optimal strategy.

It has been reasonably calculated that approximately 3,600 hands per table will be dealt in a 24-hour playing period. Based upon a $1 ante bet, 3,600 hands will equal $3,600 per 24 hour period or $1,314,000 per year. Based on 3,600 hands dealt per 24-hour period, there is a statistical probability of approximate bonus payouts per table per year of $650,000 per year. There is an estimated profit of $650,000 per table, per game, per year. The basis for such estimates are set forth in the following Tables 1, 2, and 3 for each of the games previously mentioned, Joker Poker, Deuces Wild, and Draw Poker.

TABLE 1

JOKER WILD ANALYSIS

| PAY TABLE | ODDS | Times/Cycle | Bonus Award | PAYOUT |
|---|---|---|---|---|
| Royal Flush | 500–1 | 4 | 30,000 | 120,000 |
| 5 of a Kind | 200–1 | 13 | 12,500 | 162,500 |
| Wild Royal | 100–1 | 20 | 5,000 | 100,000 |
| Strt. Flush | 40–1 | 180 | 1,500 | 270,000 |
| 4 of a Kind | 15–1 | 3120 | 250 | 780,000 |
| Full House | 6–1 | | Total | 1,432,500 |
| Flush | 3–1 | | Drop | 2,869,685 |
| Straight | 2–1 | | Win | 1,437,185 |
| 3 of a Kind | 1–1 | | VIG on ANTE | 50.1% |
| Two Pairs | Push | | | |
| Pair K's | Push | | | |
| Payback % | 94.58 | OPTIONAL ANTE $1.00 Bet | | |

TABLE 1-continued

JOKER WILD ANALYSIS

Adjustments for Forfeits:

| HAND TYPE | Quantity | Increase by: | Increase % |
|---|---|---|---|
| Draw 5 | 320,844 | 0.1772 | 1.98 |
| Double Ins Strt Flush | 31,860 | 0.05 | 0.06 |
| Ace or King | 508,836 | 0.0541 | 0.96 |
| Ace and King | 13,032 | 0.0624 | 0.03 |
| Two Card Royals | 39,492 | 0.1748 | 0.27 |
| | | Total Payback % | 97.87 |

TABLE 2

DEUCES WILD ANALYSIS

| PAY TABLE | ODDS | Times/Cycle | Bonus ($) | PAYOUT (%) |
|---|---|---|---|---|
| Royal Flush | 500–1 | 4 | 25,000 | 100,000 |
| Four Deuces | 200–1 | 48 | 3,000 | 144,000 |
| Wild Royal | 20–1 | 480 | 950 | 456,000 |
| 5 of a Kind | 12–1 | 624 | 450 | 280,800 |
| Strt. Flush | 8–1 | 2,136 | 150 | 320,400 |
| 4 of a Kind | 3–1 | | Total | 1,301,200 |
| Full House | 2–1 | | Drop | 2,598,960 |
| Flush | 1–1 | | Win | 1,297,760 |
| Straight | 1–1 | | VIG on ANTE | 49.9% |
| 3 of a Kind | Push | | | |
| Payback % | 92.34 | OPTIONAL ANTE $1.00 Bet | | |

Adjustments for Forfeits:

| HAND TYPE | Quantity | Increase by: | Increase % |
|---|---|---|---|
| Draw 5 | 502,308 | 0.195 | 3.77 |
| Double Ins Strt Flush | 13.512 | 0.145 | 0.08 |
| Inside Straight | 114,180 | 0.160 | 0.70 |
| Inside Strt. Flush | 13,032 | 0.062 | 0.03 |
| Two Card Royals | 53,340 | 0.183 | 0.38 |
| Deuce (solo) | 338,112 | −0.006 | −0.78 |
| | | Total Payback % | 96.51 |

TABLE 3

JACKS or BETTER ANALYSIS

| PAY TABLE | ODDS | Times/Cycle | Bonus ($) | PAYOUT (%) |
|---|---|---|---|---|
| Royal Flush | 500–1 | 4 | 25,000 | 100,000 |
| Strt Flush | 100–1 | 36 | 3,500 | 126,000 |
| 4 of a Kind | 25–1 | 624 | 350 | 218,400 |
| Full House | 6-1 | 3,744 | 125 | 468,000 |
| Flush | 4-1 | 5,108 | 75 | 383,100 |
| Straight | 3-1 | | Total Pay | 1,295,500 |
| 3 of a Kind | 2-1 | | Drop | 2,598,960 |
| Two Pairs | 1-1 | | Win | 1,303,460 |
| Pair Jacks | Push | | VIG on ANTE | 50.2% |
| Payback % | 96.24% | OPTIONAL ANTE $1.00 Bet | | |

Adjustments for Forfeits:

| HAND TYPE | Quantity | Increase by: | Increase % |
|---|---|---|---|
| Draw 5 | 84,360 | 0.1449 | 0.47 |
| Dbl Ins Strt Flu (0 Hi Cd) | 6,768 | 0.0504 | 0.01 |
| One High Card | 402,528 | 0.0275 | 0.43 |
| Two High Cards | 386,148 | 0.00805 | 0.12 |
| Two Card Royals | 30,072 | 0.02 | 0.02 |
| | | Total Payback % | 97.29% |

It is also possible to utilize the present inventive bonus and/or jackpot even where the players are not permitted to select the game just prior to the deal. For example, if the table in EXAMPLE 1 were to be restricted to Deuces Wild, the play would be the same, and the bonuses and jackpot payments would be made as stated therein. The same also would be true if the table were restricted to any one of the other poker games. The only difference: pre-deal selection of the game to be played, by the players, would not occur.

Our invention has been disclosed in terms of a preferred embodiment thereof, which provides an improved player-option casino game system of great novelty and utility. Various changes, modifications, and alterations in the teachings of the present invention may be contemplated by those skilled in the art without departing from the intended spirit and scope thereof. It is intended that the present invention encompass such changes and modifications.

We claim:

1. A method of play for casino playing card games comprising;

(a) providing an array of multiple poker playing card games consisting solely of Draw Poker, Deuces Wild Poker and Joker Poker, each having associated rules of play, wherein each playing card game of said array has at least one individualized rule of play in comparison to all other playing card games in said array;

(b) providing a gaming table containing a number of individual compartments viewable by players, each compartment individually holding only one deck of playing cards associated with only one of the poker playing card games and a playing surface, both of proper configuration to play any one of said array of multiple playing card games in accordance with established rules of play for each of said playing card games;

(c) each player selecting one of said playing card games from among said array of playing card games to be played by all players at the gaming table prior to any wagering by any player;

(d) each player making a first wager;

(e) a dealer obtaining a deck of playing cards appropriate for said selected one of said playing card games from one of said number of individual compartments;

(f) the dealer dealing from said set of playing cards to each of said players having made a first wager in accordance with established rules of play for said selected one of said playing card games;

(g) each of said players optionally discarding and drawing one or more additional playing cards in accordance with established roles of play for said selected one of said playing card games;

(h) the dealer comparing the playing cards of each of said players to a schedule of winning results set forth in accordance with established rules of play for said selected one of said playing card games;

(i) the dealer settling the wagers in accordance with said schedule of winning results; and (j) selectively initiating and playing new games by the repetition of steps (c)–(i) whereby, each game played at the gaming table is a result of a player selection made from among multiple playing card games.

2. A method of play for casino playing card games as described in claim 1, wherein a bonus result is provided, and further comprising:

each player optionally placing an ante bet concurrently with the making of a first wager;

the dealer comparing the playing cards of each of said players as have placed said ante bet to a second schedule of winning bonus results set forth in accordance with established rules of play for said selected one of said playing card games; and the dealer settling the ante wagers in accordance with said schedule of winning bonus results.

3. A method of play for casino playing card games as described in claim 2, wherein said dealer comparison of player playing cards to a second schedule of winning bonus results includes only such players as do not elect to discard and draw playing cards in accordance with step (g) during play of the playing card game.

4. A method of play for casino playing card games as described in claim 2, and further comprising:

comparing the playing cards of each of said players as have made an ante wager to a jackpot payoff schedule; and the dealer settling the ante wagers in accordance with said jackpot payoff schedule.

5. A method of play for casino playing card games as described in claim 1, wherein the dealing step (f) comprises the dealer dealing five playing cards to each player, and each of said players may optionally discard and draw up to three additional playing cards in step (g).

6. A method of serially playing multiple different playing card games at a gaming table containing a number of individual compartments viewable by players, each compartment individually holding only one deck of playing cards associated with only one of the multiple different playing card games comprising:

(a) each player selecting a playing card game to be played by all players at the gaming table from optionally three different poker playing card games consisting solely of Draw Poker, Deuces Wild Poker and Joker Poker;

(b) each player making a wager to participate in said selected playing card game;

(c) a dealer obtaining a deck of playing cards appropriate for the play of said selected playing card game from one of said number of individual compartments;

(d) the dealer dealing a set number of playing cards to each player, said set number as determined in accordance with a set of established rules for said selected playing card game;

(e) each player optionally discarding and drawing one or more additional playing cards in accordance with said set of established rules for said selected playing card game;

(f) the dealer comparing the playing cards of each player to a schedule of winning results previously assigned to said selected playing card game;

(g) the dealer settling wagers made by each player in accordance with said schedule of winning results; and (h) initiating and playing another of said multiple different playing card games by the repetition of steps (a)–(g).

7. The method of claim 6, wherein each player makes a wager to participate after the selection of a playing card game has occurred in step (a).

8. The method of claim 6, wherein each of said different playing card games requires a separate, individualized deck of playing cards, and further comprising:

providing the dealer with a plurality of separate decks of playing cards, each of said decks including the playing cards specified by the rules of play for use in the play of one of said different playing card games, with said plurality of separate decks collectively encompassing the playing cards required for all of said different playing card games.

9. The method of claim 8, further comprising:

providing the dealer with three sets of playing cards, each of said decks including the playing cards specified by the rules of play for use in the play of one of said card games, and wherein each player may optionally discard and draw up to three additional playing cards.

10. The method of claim 6, wherein each player makes a second, ante wager after the selection of a playing card game has occurred in step (a), and further comprising:

the dealer comparing the playing cards of each player as has made the ante wager to a second schedule of bonus results previously assigned to said selected playing card game; and the dealer settling the first and second wagers made by each player in accordance with said schedule of winning results and with said second schedule of bonus results.

11. The method of claim 10, wherein the dealer compares only the playing cards of those players not having discarded any playing cards to said second schedule of bonus results.

12. The method of claim 10, and further comprising:

the dealer comparing the playing cards of each player to a third schedule of jackpot results previously assigned to said selected playing card game; and the dealer settling any successful results from said comparison with said third schedule of jackpot results by distributing a jackpot amount equally among each of the players.

13. The method of claim 12, and further comprising:

each player optionally making an ante bet prior to the dealing of any playing cards, and wherein only the playing cards of those players making an ante bet are compared with said third schedule of jackpot results, and only those players making an ante bet share in the distribution of said jackpot amount.

14. An apparatus for playing one of a selected number of different poker playing card games, wherein one or more players play against a pre-established payout schedule, said apparatus comprising:

a plurality of decks of playing cards, the number of decks of playing cards corresponding to the different poker card games;

a gaming table:

a plurality of poker player playing positions at spaced locations adjacent said gaming table;

a dealer position at a location adjacent said gaming table substantially opposite said plurality of poker player playing positions; and a multi-deck card holder placed on said gaming table at a location adjacent said dealer position, said multi-deck card holder provided with a plurality of individual card deck compartments formed therein; wherein the number of individual card deck compartments formed in said multi-deck card holder corresponds to the number of decks of playing cards, and each card deck compartment consisting of only one deck of playing cards wherein each of said card deck compartments being configured to hold only one deck of playing cards for playing one of said selected number of different poker playing card games.

15. The apparatus of claim 14, wherein at least two of said selected number of different playing card games require separate, individualized decks of playing cards, and wherein said multi-deck card holder is provided with an individual card deck compartment for each of said separate, individualized decks of playing cards.

16. The apparatus of claim 14 and further comprising a cover panel attached to each of said individual card deck compartments of said multi-deck card holder.

17. The apparatus of claim 16, wherein said cover panel is attached to each of said individual card deck compartments by a hinged connection.

18. The apparatus of claim 14, wherein said multi-deck card holder is provided with three individual card deck compartments.

19. The apparatus of claim 14, and further comprising a jackpot merchandiser placed on said gaming table at a location adjacent said dealer position.

20. An apparatus for playing one of a selected number of different playing card games, wherein one or more players play against a pre-established payout schedule, said apparatus comprising:

a plurality of decks of playing cards, the number of decks of playing cards corresponding to the number of different poker playing card games;

a gaming table;

a plurality of player playing positions at spaced locations adjacent said gaming table;

a dealer position at a location adjacent said gaming table substantially opposite said plurality of player playing position; and a multi-deck card holder placed on said gaming table at a location adjacent said dealer position, said multi-deck card holder provided with a plurality of individual card deck compartments formed therein, wherein the number of individual card deck compartments formed in said multi-deck card holder corresponds to the number of decks of playing cards, and each card deck compartment consisting of only one deck of playing cards, wherein each of said card deck compartments being configured to hold only one deck of playing cards and further comprising:

a plurality of player playing areas defined on said gaming table as locations such that each player playing area is located adjacent a separate one of said player playing positions, wherein each of said plurality of player playing areas further define a plurality of individual fields, including a bet field, an ante field, a payoff field, and a bonus field.

21. A method of play for casino playing card games comprising:

(a) providing an array of multiple poker playing card games for play at a gaming table containing a number of individual compartments viewable by players, each compartment individually holding only one deck of playing cards associated with only one of the multiple poker playing card games, each having associated rules of play, wherein each poker playing card game of said array has at least one individualized rule of play in comparison to all other poker playing card games in said array;

(b) each player at said gaming table selecting one of said poker playing card games from among said array of poker playing card games to be played by all players at said gaming table;

(c) making a wager;

(d) receiving cards from a deck of playing cards from one of said number of individual compartments and in accordance with established rules of play for the selected one of said poker playing card games;

(e) optionally retaining said cards from the set of playing cards or discarding and drawing one or more additional playing cards in accordance with established rules of pray for said selected one of said poker playing card games; and (f) receiving a payout if a final set of five playing cards is a winning hand in accordance with a schedule of winning results associated with the said selected one of said poker playing card games.

22. A method of play for casino playing card games as described in claim 21 wherein said array of multiple playing card games includes Draw Poker, Deuces Wild, and Joker Poker.

23. A method of play for casino playing card games comprising:

(a) providing an array of multiple poker playing card games for play at a gaming table containing a number of individual compartments viewable by players, each compartment individually holding only one deck of playing cards associated with one of the multiple poker playing card games by only players at the gaming table exclusive of a dealer, each poker playing card game having associated rules of play wherein each poker playing card game of said array has at least one individualized rule of play in comparison to all other poker playing card games in said array;

(b) selecting one of said poker playing card games from among said array of poker playing card games from one of said number of individual compartments and;

(c) each player making a wager;

(d) only the players at the gaming table exclusive of the dealer receiving five cards from a set of playing cards in accordance with established rules of play for the selected one of said poker playing card games;

(e) each player optionally retaining said cards from the set of playing cards or discarding and drawing one or more additional playing cards in accordance with established rules of play for said selected one of said poker playing card games; and (f) receiving a payout if a final set of five playing cards is a winning hand in accordance with a schedule of winning results associated with the said selected one of said poker playing card games.

* * * * *